US011351539B2

(12) United States Patent
Lenci

(10) Patent No.: US 11,351,539 B2
(45) Date of Patent: Jun. 7, 2022

(54) MULTILEVEL MICROFLUIDIC DEVICE

(71) Applicant: IMEC VZW, Leuven (BE)

(72) Inventor: Silvia Lenci, Linden (BE)

(73) Assignee: IMEC VZW, Leuven (BE)

( * ) Notice: Subject to any disclaimer, the term of this patent is extended or adjusted under 35 U.S.C. 154(b) by 144 days.

(21) Appl. No.: 16/706,292

(22) Filed: Dec. 6, 2019

(65) Prior Publication Data

US 2020/0197932 A1 Jun. 25, 2020

(30) Foreign Application Priority Data

Dec. 20, 2018 (EP) ..... 18214388

(51) Int. Cl.
*B01L 3/00* (2006.01)

(52) U.S. Cl.
CPC ..... *B01L 3/502707* (2013.01)

(58) Field of Classification Search
CPC ..... B01L 2200/12; B01L 2300/0874; B01L 2300/0887; B01L 3/502707
See application file for complete search history.

(56) References Cited

U.S. PATENT DOCUMENTS 9,782,773 B2 10/2017 Astier et al.
2011/0257040 A1* 10/2011 Turner ..... B01L 3/5085 506/16
2013/0112650 A1* 5/2013 Karam ..... B23K 26/32 216/13
2013/0296174 A1 11/2013 Peumans

FOREIGN PATENT DOCUMENTS

EP 3088076 A1 11/2016
WO 2017/075598 A1 5/2017

OTHER PUBLICATIONS

European Search Report, European Patent Application No. 18214388.3, dated May 13, 2018, 13 pages.

* cited by examiner

*Primary Examiner* — Jennifer Wecker
(74) *Attorney, Agent, or Firm* — McDonnell Boehnen Hulbert & Berghoff LLP

(57) ABSTRACT

A multi-level microfluidic device is provided. The device includes a silicon wafer substrate and a stack of layers arranged on the silicon wafer substrate. The stack comprises a plurality of fluidic silicon layers, wherein each fluidic silicon layer includes a microfluidic structure at least one intermediate layer. The at least one intermediate layer is arranged between two fluidic silicon layers, and a fluid inlet and a fluid outlet in fluid connection with at least one of the fluidic silicon layers. Each layer in the stack is formed by deposition or growth. Methods for manufacturing microfluidic devices is also provided.

10 Claims, 7 Drawing Sheets

305a
302
301
323

302
303
301
322

302
301
321

402
401
421

403
402
401
422

403
402
405a
401
423

MULTILEVEL MICROFLUIDIC DEVICE

CROSS-REFERENCE TO RELATED APPLICATIONS

The present application is a non-provisional patent application claiming priority to European Patent Application No. 18214388.3, filed Dec. 20, 2018, the contents of which are hereby incorporated by reference in its entirety.

FIELD OF THE DISCLOSURE

The present disclosure relates to the field of microfluidic devices. In particular it relates to multilevel microfluidic devices and methods of manufacturing the same.

BACKGROUND OF THE DISCLOSURE

Microfluidic devices have been developed for a variety of applications in for example chemistry and biology and may be used for manipulating extremely small volumes of fluids, such as at the nanoliter level or below. An application is the use of microfluidic devices to perform chemical reactions in a vast number of microreactors located in the microfluidic device, such as on a microfluidic chip. Microfluidic devices may be commonly used in the industry today in several applications, such as for example in the lab-on-a-chip industry, which is attracting increasing attention owing to its accessibility, availability and space efficient apparatuses.

In many microfluidic applications, it may be beneficial if the microfluidic device comprises several levels of microfluidic structures, that may or may not be in fluid communication with each other. Multilevel microfluidics may allow for more compact device size, thus enabling multiple operations in parallel. In fact, on each microfluidic level, different methods or assays may be performed. Thus, multilevel microfluidic devices may be a material efficient way of providing devices capable of performing several methods or test, either simultaneously or in series.

In the prior art, multi-level microfluidic devices have been fabricated by wafer bonding. In wafer bonding, two or more silicon wafers, generally comprising structures for fluidic transport, may be bonded together. Wafer bonding is a term which defines several techniques commonly used for bonding together silicon wafers that may be commonly used in the CMOS industry today. Known wafer bonding technologies include direct bonding, surface activated bonding, plasma activate bonding, eutectic bonding, anodic bonding, and many other technologies.

However, in order to form multilevel microfluidic devices in silicon using wafer bonding, as many silicon wafers as levels is required. Thus, to form a multilevel microfluidic device having three levels, three wafers may be required. Using wafer bonding to form multilevel microfluidic devices is therefore material inefficient. Furthermore, wafer-to-wafer alignment is necessary with wafer bonding. Wafer bonded multilevel devices suffer from poor alignment resolution, making it difficult to obtain highly resolved microfluidic structures as needed for some applications, as well as making the scaling down of the fluidic structures more difficult.

Therefore, a wafer bonding manufacturing step makes it a longer flow, more expensive and disadvantageous in terms of alignment between the fluidic layers of the two wafers.

Lamination techniques may be used as well, but these may not be so straight-forward and the resolvable microfluidic dimensions may be highly dependent to the dry film which is used for lamination.

Therefore, there exists a need in the art to for improved multi-level micro-fluidic devices and methods for producing them.

SUMMARY OF THE DISCLOSURE

It is an object of the disclosure to at least partly overcome one or more limitations of the prior art. In particular, it is an object to provide a multilevel microfluidic device with improved compactness and device sensitivity.

In a first aspect of the disclosure, there is provided a multi-level microfluidic device comprising

- a silicon wafer substrate;
- a stack of layers arranged on the silicon wafer substrate, wherein said stack comprises
  - a plurality of fluidic silicon-based layers, wherein each fluidic silicon-based layer comprises a microfluidic structure;
  - at least one intermediate layer, wherein the at least one intermediate layer is arranged between two fluidic silicon-based layers, and
  - a fluid inlet and a fluid outlet in fluid connection with at least one of the fluidic silicon-based layers,
  - wherein each layer in the stack is formed by deposition or growth.

By providing a microfluidic device which can be fabricated without steps of wafer bonding, a compact device with highly resolved microfluidic structures can be obtained.

The device according to the first aspect comprises a plurality of layers that each have been arranged on top of an underlying layer (or the substrate, for the first layer) by deposition or growth. In examples of the present disclosure, the fluidic layers and the intermediate layers may not be put together by any kind of wafer bonding. Wafer bonding is a known method. Typically, wafer bonding can be used to bond silicon wafers to each other. Thus, each bonding steps typically requires the use of at least two silicon wafers.

Instead, examples of the present disclosure provide for a multilevel microfluidic device which does not require any wafer bonding to form the fluidic silicon-based layers and the intermediate layers. This may be beneficial in that it allows for more compact devices, for multiple fluid inlets and outlets in each layer, and for an increased device sensitivity. Examples of the present disclosure provide an improved device sensitivity in particular since the no bonding approach provides microfluidic devices with higher structural resolution and more downscaling towards smaller dimensions within each fluidic layer than conventional microfluidic devices. In examples, each microfluidic structure is created by deposition (or growth) and lithography steps in a step-by-step process wherein each layer is provided by deposition or growth on the underlying layer which yields a higher accuracy and thus a higher resolution in the microfluidic structures.

In examples of the present disclosure, the substrate is generally silicon wafers, such as monocrystalline silicon wafers.

Herein, the term "fluidic silicon-based layer" refers to a fluidic layer comprising a silicon material, such as, for example, (polycrystalline) silicon, silicon carbide or silicon nitride.

Herein, the term "microfluidic structure" refers to a structure capable handling very minute volumes of fluid. The microfluidic structures may generally allow for a flow of fluid from an inlet to an outlet, or from an inlet to a fluid interconnection connecting different fluid silicon layers of the multilevel device. Microfluidic structures generally comprise channels, grooves, and/or wells adapted for transportation of said fluid. The microfluidic structure may also comprise different geometrical structures having a variety of geometries, such as for example rectangular or pyramidal elements, pillars, filters, etc. The size of the geometries, as well as of the microfluidic space between them, can vary from microns down to (tenths of) nanometers, dependent on the nature and composition of the fluid. Typical volumes transported in such fluidic devices can range from microliters down to picoliters. The microfluidic structure may be connected to control means for controlling the flow of fluids in the microfluidic structure. The control means may comprise pumps or valves. The microfluidic structure may further be provided with grooves or chambers adapted to house different capture probes, reagents and output electronics. The structures may be formed by means of photolithographic masking and physical and/or chemical etching. Photolithographic masking and etching are known and are commonly used to create structures in CMOS and/or MEMS technology.

The term "intermediate layer" refers to a layer that may be positioned between the fluidic silicon-based layers. The intermediate layer may isolate the fluidic silicon-based layers from fluid communication with each other. The fluidic silicon-based layer may also be provided with passages that allows for fluid contact between different fluidic silicon-based layers, usually between adjacent fluidic silicon-based layers. The intermediate layers may be silicon-based, or comprise a dielectric material, such as $SiO_2$.

In examples of the present disclosure, each fluidic silicon-based layer may be separated from the next fluidic silicon-based layer by an intermediate layer. Thus, multilevel microfluidic devices can be formed which does not require the use of wafer bonding for separating and providing additional fluidic layers. Thus, the number of intermediate layers in the present disclosure may be equal to the number of fluidic silicon layers minus one. For example, when three fluidic silicon-based layers are provided, the number of intermediate layers provided can be two. Thus, each fluidic silicon-based layer can be separated from the adjacent fluidic silicon-based layer(s) by an intermediate layer.

Herein, the term "deposition or growth" denotes techniques that do not involve wafer bonding. Deposition includes for example chemical vapor deposition and/or physical vapor deposition. The term growth includes for example "epitaxial growth", "layer-by-layer", "joint islands", "layer-plus-island" and/or "isolated islands" growth modes. In contrast to multi-level devices fabricated with wafer bonding, the multi-level microfluidic devices according to examples of the present disclosure can be manufactured in a very material efficient manner, where as much material as needed can be deposited or grown on the underlying layers or substrate to form the multi-level microfluidic device, without the need for wafer bonding/thinning or other highly material consuming techniques. The disclosure can require the use of only one silicon wafer and can achieve higher alignment resolution using deposition. Thus, the component of the present disclosure that may comprise monocrystalline silicon wafers as the substrate, and optionally a final capping provided to close the top fluidic silicon-based layer. However, in embodiments, the final capping may at least be partially transparent. Thus, materials such as glass or polymers may be typically used in the final capping.

According to an example, the device also comprises at least one fluid inlet and at least one fluid outlet, both in fluid connection to at least one fluidic silicon-based layer. In one example, at least one inlet should be in fluid connection with at least one outlet.

In a generalized form of the device according to an example of the disclosure, the multi-level microfluidic device comprises a substrate and a stack including a first and a second fluidic silicon-based layer separated by one intermediate layer. Example devices of the present disclosure may be highly scalable and may include stacks of several fluidic silicon-based layers separated by intermediate layers, such as at least 2, 3, 4, or more layers. According to an example, the stack comprises an alternating structure of fluidic silicon-based layers and intermediate layers.

In some embodiments, said deposition may be chemical vapor deposition or physical vapor deposition. Both vapor deposition techniques can be used to deposit a wide range of material. Deposition by chemical vapor deposition may be desirable in that the deposited material ability to conform to a pattern in the underlying layer can be tuned. Growth of the layers may be performed for example by epitaxial techniques.

In embodiments, the at least one intermediate layer comprises a fluid interconnection arranged to allow for fluid communication between adjacent fluidic silicon-based layers. This may be desirable in that it provides a device in which fluid can flow from one fluidic silicon-based layer to another. Several applications may require fluidic contact between adjacent levels in the microfluidic device. The fluid interconnection may also be provided between fluidic silicon-based layers that may not be adjacent to each other.

In some embodiments, the fluidic silicon-based layers may comprise a material that may be inert to hydrofluoric etching, such as for example (polycrystalline) silicon, $Si_XN_Y$ and/or SiC. Herein, the term "inert" refers to that the material may not be etched by hydrofluoric acid, or etched at a slower rate than $SiO_2$. Generally, according to example embodiments, the fluidic silicon-based layers may comprise a material that may be etched at a rate at least 5 times slower than silicon oxide.

In some embodiments, the material of the fluidic silicon-based layer may be chosen such that it conforms to the shape of an underlying layer during deposition. The conformity of a material may be directed during e.g. CVD deposition. Thus, in some examples, the microfluidic structures of the fluidic silicon layers may be formed by deposition of sacrificial material on a substrate, lithography/masking and subsequent etching/removal of the sacrificial material to form a pattern in the sacrificial layer, without affecting the material of the fluidic silicon-based layer, followed by the forming of a conformal silicon-based layer which conforms to the shape of the pattern in the sacrificial layer and fills all the etched area. The remaining portion of the sacrificial layer may thereafter be removed, thereby forming a fluidic silicon-based layer comprising microfluidic structures.

In other examples, the microfluidic structures of the fluidic silicon-based layers may be formed by deposition of a silicon-based material, lithography/masking and subsequent etching of the silicon-based material to form a pattern in the silicon-based material, followed by the forming of a conformal sacrificial layer.

In embodiments, at least one of the fluidic silicon-based layers comprises a microfluidic structure consisting of fluidic channels which may comprise pyramids, wells, pillars, or other different geometries.

In some embodiments, the intermediate layer comprises a material that may be inert to hydrofluoric etching, such as for example (polycrystalline) silicon, $Si_XN_Y$ and/or SiC.

Thus, the intermediate layers can be deposited to separate between the fluidic layers without being affected by etching which may be used to etch away a sacrificial layer (e.g. HF if the sacrificial layer is $SiO_2$), which may be used during the structuring of the fluidic silicon-based layer.

In embodiments, the fluidic silicon-based layers and the intermediate layers may comprise a material that may be inert to (comprising being at least slowly-etched by) hydrofluoric acid, such as for example (polycrystalline) silicon, $Si_XN_Y$ and/or SiC. Generally, according to examples, the fluidic layers and the intermediate layers comprise the same material.

In some embodiments, the intermediate layer may be made of a different material than the fluidic silicon-based layer. The intermediate material may be a material that may be susceptible to hydrofluoric acid etching. In such embodiments, the material of the fluidic silicon-based layer may typically be a material that during deposition does not conform to the shape of an underlying material. Also here, the conformity can be directed by the parameters used during chemical vapor deposition (e.g. temperature and pressure).

In embodiments, the intermediate layer(s) comprises a dielectric material, such as silicon dioxide or other oxides. Such materials may be generally susceptible to hydrofluoric etching. When the intermediate layer comprises a dielectric material, the fluidic silicon-based layers and the intermediate layers comprise different materials.

In a second aspect of the present disclosure, there is provided a method of manufacturing a microfluidic device, comprising the steps of:

a) forming a first layer of a first material on a substrate;
b) forming a first pattern in the first layer;
c) forming a first conformal layer on the first layer, wherein the conformal layer conforms to the first pattern in the first layer;
d) forming a second layer of the first material on the first conformal layer;
e) forming a second pattern in the second layer of the first material;
f) forming a second conformal layer on the second layer, wherein the second conformal layer conforms to the second pattern in the second layer of the first material;
g) removing the layers of the first material or removing the conformal layers.

At each layer formation a planarization step might be performed. Herein, the term "conformal layer" is intended to denote a layer which, after deposition (or growth), may conform to the shape of the patterned layer beneath and fills the previously etched area. In examples, the conformity of a deposited layer can be tuned by tuning deposition process parameters, such as temperature or pressure. This means that if the pattern has a hole or a well, the conformal layer will fill the hole or well.

The conformal layers may either be a silicon layer or a sacrificial layer. In embodiments, the sacrificial layer may be a dielectric layer, such as an oxide layer, for example a $SiO_2$ layer.

Herein, the term "sacrificial layer" is intended to denote a layer that may be removed in order to form the microfluidic device of the disclosure. The sacrificial layer may be used to support the formation of the levels in the microfluidic device. In embodiments, the sacrificial layer may be removed by a step of etching. The sacrificial layers may either be the layers of the first material or the conformal layers. During manufacturing, the forming of a sacrificial layer may be alternated with the forming of a silicon-based layer, or vice versa.

The sacrificial layer may be formed such that it conforms to the shape of a pattern in an underlying layer. This may be desirable when the sacrificial layer is formed as a subsequent layer on a silicon-based layer.

The step g) may be performed by removing the sacrificial layers. The sacrificial layers may either be the layers of the first material or the conformal layers.

At least one of the steps of forming a layer include forming at least one fluid inlet and/or at least one fluid outlet in fluid connection with the at least one fluid inlet. Means for forming an inlet and an outlet are known.

Below, two exemplary embodiments of the second aspect are discussed.

In an embodiment of the second aspect, there is provided a method of manufacturing a microfluidic device, comprising the steps of:

a) forming a first sacrificial layer on a substrate;
b) forming a first pattern in the first sacrificial layer;
c) forming a first conformal layer on the first sacrificial layer, wherein the conformal layer conforms to the first pattern in the first sacrificial layer;
d) forming a second sacrificial layer on the first conformal layer;
e) forming a second pattern in the second sacrificial layer;
f) forming a second conformal layer on the second sacrificial layer, wherein the second conformal layer conforms to the second pattern in the second sacrificial layer;
g) removing the sacrificial layers.

At each layer formation a planarization step might be inserted.

Thus, there is provided a method wherein, on a substrate, such as a silicon wafer substrate, a first sacrificial layer may be formed. In this embodiment, the layers of the first material may be the sacrificial layers. In embodiments, the first sacrificial layer may be a dielectric material, such as $SiO_2$ and should be susceptible to etching using e.g. hydrofluoric acid. Like the subsequent layers, in embodiments, the first sacrificial layer may be formed by deposition or growth. After the forming of the first sacrificial layer on the substrate, a pattern may be formed in the sacrificial layer, usually by photolithographic masking and subsequent etching. Thereafter, a conformal layer may be formed on top of the patterned sacrificial layer by means of deposition or growth.

After the conformal layer is formed on top of and conforming to the shape of the pattern in the first sacrificial layer, a second sacrificial layer may be formed on top of the first conformal layer. A pattern may be formed in the second sacrificial layer in the same or a similar manner as in the first sacrificial layer, after which yet another conformal layer may be deposited in top of the second sacrificial layer. In embodiments, the second conformal layer may be made of the same material as the first conformal layer. During deposition, the second conformal layer may conform to the pattern in the second sacrificial layer. In embodiments, the second sacrificial layer may be made of the same material as the first sacrificial layer. The subsequent steps of forming and patterning a sacrificial layer and forming a conformal layer can be repeated to form a multi-level micro-fluidic device having as many levels as desired.

After a desired amount of levels has been formed, the sacrificial layers can be etched away by hydrofluoric acid. In embodiments, the hydrofluoric acid may be provided through a fluid inlet which optionally has been formed during the manufacturing of the multi-level device. Thus, when the sacrificial layers have been etched away, a multi-level device may be formed. Layers of the device may thus formed by the conformal layers, where the parts of the conformal layers conforming to the patterns formed in the sacrificial layers may form the fluidic silicon layers as described in the first aspect herein, and the part of the conformal layer that is deposited on top of the filled, patterned sacrificial layer can make up the intermediate layers. Thus, in some examples, the stack may be formed by the same material, such as polycrystalline silicon.

In another embodiment of the second aspect, there is provided a method of manufacturing a microfluidic device, comprising the steps of:

a) forming a first silicon-based layer on a substrate;
b) forming a first pattern in the first silicon-based layer;
c) forming a first conformal sacrificial layer on the first silicon-based layer, wherein the first conformal sacrificial layer conforms to the first pattern in the first silicon-based layer;
d) forming a second silicon-based layer on the first sacrificial conformal layer;
e) forming a second pattern in the second silicon-based layer;
f) forming a second conformal sacrificial layer on the second silicon-based layer, wherein the second sacrificial conformal layer conforms to the second pattern in the second silicon-based layer;
g) removing the sacrificial layers.

At each layer formation, a planarization step may be inserted.

Thus, there is provided a method wherein, on a substrate, such as a silicon wafer substrate, a first layer of a first material may be formed. The first material may be a silicon-based material, such as for example (poly)crystalline silicon. Like the subsequent layers and in embodiments, the first layer may be formed by deposition or growth. After the forming of the first layer on the substrate, a pattern may be formed in the first layer, usually by photolithographic masking and subsequent etching. Thereafter, a sacrificial conformal layer may be formed on top of the patterned layer by means of deposition or growth. In some examples, the first layer may be an upper portion of the substrate.

After the conformal layer is formed on top of and conforming to the shape of the pattern in the first layer, a second layer of the first material may be formed on top of the first sacrificial conformal layer. A pattern may formed in the second layer in the same or a similar manner as in the first layer, after which yet another sacrificial conformal layer may be deposited on top of the second layer. In embodiments, the second sacrificial conformal layer may be made of the same material as the first sacrificial conformal layer. During deposition, the second sacrificial conformal layer conforms to the pattern in the second layer. The subsequent steps of forming and patterning a layer of the first material and forming a sacrificial conformal layer can be repeated to form a multi-level micro-fluidic device having as many levels as desired. After a desired amount of levels has been formed, the sacrificial layers can be etched away by hydrofluoric acid. In embodiments, the hydrofluoric acid may be provided through a fluid inlet which optionally has been formed during the manufacturing of the multi-level device. Thus, when the sacrificial layers have been etched away, a multilevel device may be formed. Layers of the device may thus be formed by the layers of the first material, usually (polycrystalline) silicon.

In some embodiments, the method of the second aspect further comprises a step of planarizing the stack, usually by applying chemical-mechanical (CMP) techniques.

In some embodiments, the silicon-based layers comprise a material that may be inert to hydrofluoric etching, such as for example (polycrystalline) silicon, $Si_XN_Y$, and/or SiC. Such materials may be deposited or grown using known deposition and growth techniques, such as CVD and PVD for the case of deposition. They can also be deposited under conditions which allows them to conform to a pattern in an underlying layer.

In embodiments, the sacrificial layer comprises a dielectric material, such as silicon dioxide. Dielectric materials may typically be etched by hydrofluoric acid.

In a third aspect of the present disclosure, there is provided an alternative method of forming a microfluidic device, comprising a) forming a first silicon-based layer on a substrate;
b) forming a first pattern in the first silicon-based layer;
c) forming a first non-conformal layer on the first silicon-based layer, wherein the first non-conformal layer does not conform to the first pattern in the first silicon-based layer;
d) forming a second silicon-based layer on the first non-conformal layer;
e) forming a second pattern in the second silicon-based layer;
f) forming a second non-conformal layer on the first silicon-based layer, wherein the second non-conformal layer does not conform to the second pattern in the first silicon-based layer.

The alternative method provided in the third aspect of the present disclosure provides an alternative approach for the manufacture of a multi-level device as disclosed in the first aspect of the present disclosure. On a silicon wafer, a first silicon-based layer, such as a (polycrystalline) silicon layer, may be formed by deposition or growth. A pattern may be formed in the silicon-based layer, such as by means of photolithographic masking and subsequent etching. Thereafter, a non-conformal layer may be formed on top of the silicon-based layer.

Herein, the term "non-conformal layer" denotes a layer which does not conform to the shape of a pattern in an underlying layer. A non-conformal layer does not fill holes or wells present in the underlying layer given that the size of the holes or wells does not exceed a certain size. The non-conformity of a layer may be tuned by tuning the deposition parameters. The non-conformal layer may be a dielectric layer, such as a silicon dioxide layer.

On top of the non-conformal layer a subsequent silicon layer may be formed and a pattern therein is formed. Thereafter, a subsequent non-conformal layer may be formed by deposition or growth on top of the second patterned silicon layer.

The silicon-based layer may be for example a (polycrystalline) silicon layer, a silicon nitride layer, or a silicon carbide layer. The patterned silicon-based layer should be understood to be synonymous to the fluidic silicon-based layer of the first aspect, wherein the patterning provides the microfluidic structure. The non-conformal layer of the third aspect forms the intermediate layers separating the fluid silicon-based layers.

In embodiments, the steps of forming layers may be performed by deposition or growth. The deposition or growth may be described in further detail in relation to the first aspect of the present disclosure.

In some embodiments, the silicon-based layers comprise a material that may be inert to hydrofluoric etching, such as for example (polycrystalline) silicon, $Si_XN_Y$, and/or SiC.

In some embodiments, the non-conformal layer comprises a dielectric material, such a silicon oxide. Thus, the intermediate layers of the final product becomes electrically insulating, which may be advantageous in certain embodiments.

In some embodiments, the method of the second third further comprises a step of planarizing the stack, usually by applying chemical-mechanical (CMP) techniques.

The second and third aspects disclosed herein provides further example methods that also allow for a material efficient approach for manufacturing a multi-level microfluidic device, namely because they only require the use of a single wafer substrate, as compared to approaches involving wafer bonding. In addition, the methods disclosed herein do not require complicated steps of aligning two wafers in a wafer bonding step. Instead, more accurate approaches such as photolithographic masking and etching can be used.

The processes disclosed in the second and third aspects may further comprise a step of forming an inlet and an outlet in the multi-level microfluidic devices.

BRIEF DESCRIPTION OF THE DRAWINGS

The above, as well as additional objects, features and advantages of the present disclosure, will be better understood through the following illustrative and non-limiting detailed description, with reference to the appended drawings. In the drawings like reference numerals will be used for like elements unless stated otherwise.

FIG. 3*a* shows the first step 321 of forming a sacrificial layer 302 on a substrate 301. FIG. 3*b* shows the second step 322 of forming a first pattern 303 in the first sacrificial layer 302. FIG. 3*c* shows the step 323 of forming a first conformal layer 305*a* on the first sacrificial layer 302. FIG. 3*d* shows the subsequent steps 324, 325 of forming a second sacrificial layer 306 on top of the first conformal layer and forming a second pattern 307 in the second sacrificial layer. FIG. 3*e* shows the step of forming 326 a second conformal layer 305*b* on top of the second patterned 306 sacrificial layer. FIG. 3*f* shows the stack after steps of forming 327 a third sacrificial layer, forming 328 a pattern in the third sacrificial layer, and forming 329 a third conformal layer 310 such that it fills the space between the formed pattern. FIG. 3*g* shows the step of forming 330 a fluid inlet 308 and a fluid outlet 309. FIG. 3*h* shows the step 331 of removing the sacrificial layers to form a multi-level microfluidic device.

FIG. 4*a* shows the first step 421 of providing a first silicon-based layer 402 on a substrate 401. FIG. 4*b* shows the step 422 of forming a first pattern 403 in the first silicon-based layer 402. FIG. 4*c* shows the step 423 of forming a first non-conformal layer 405*a* on the first silicon-based layer. FIG. 4*d* shows the subsequent step 424 of forming a second silicon-based layer 406 on the first non-conformal layer 405*a* and the step 425 of forming a pattern 407 in the second silicon-based layer. FIG. 4*e* shows the step 426 of forming a second non-conformal layer 405*b* on the second silicon-based layer 406. FIG. 4*f* shows the step 427 of forming a fluid inlet 408 and a fluid outlet 409 in fluid communication with each other.

DETAILED DESCRIPTION OF THE DISCLOSURE

Figure 1:
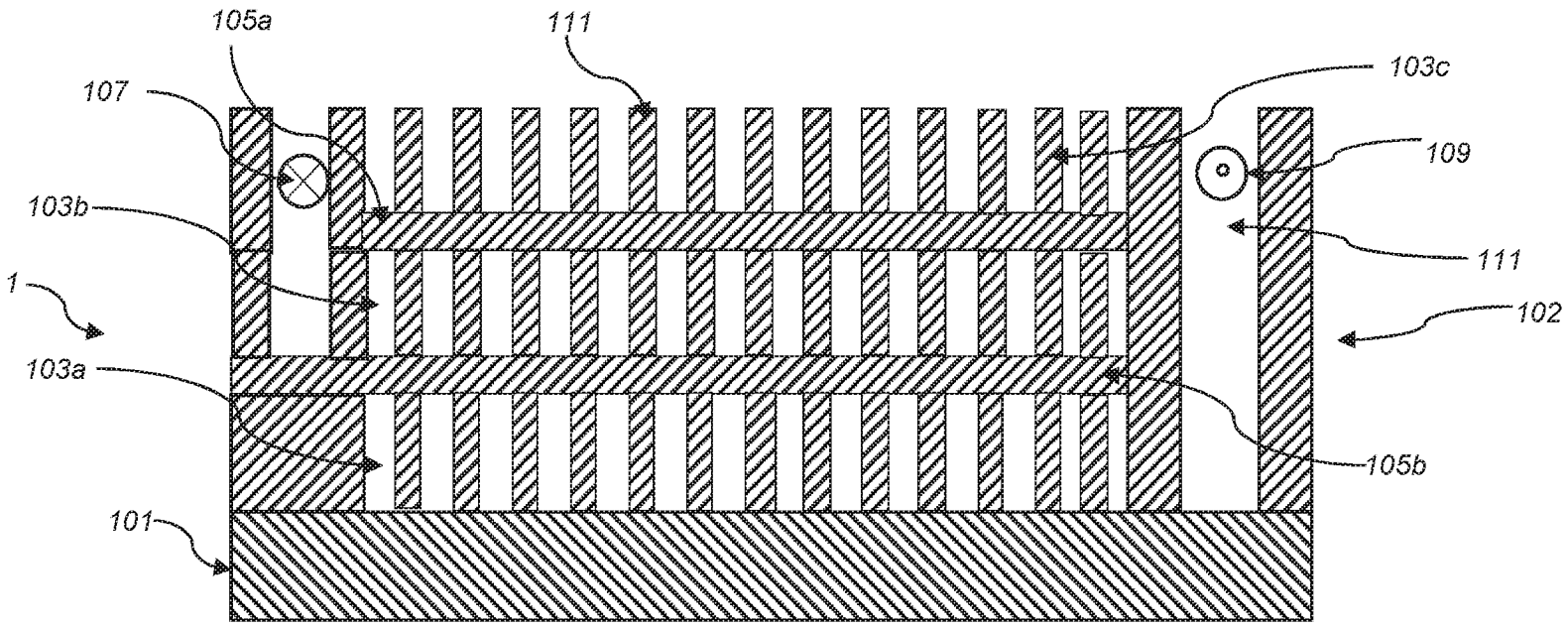
FIG. 1 is a schematic illustration in a cross-sectional view of a representative microfluidic device according to an example of the present disclosure.

FIG. 1 shows a schematic illustration of a microfluidic device 1 according to an example of the present disclosure. In the example shown therein, the device 1 comprises three fluidic silicon-based layers 103*a-c*, and two intermediate layers 105*a-b*. The intermediate layer 105*a* separates the fluidic silicon-based layers 103*a* and *b*, and the intermediate layer 105*b* separates the fluidic silicon-based layers 103*b* and *c*. The layers 103*a-c* and 105*a-b* make up a stack 102. The device may be further provided with a fluid inlet 107 and a fluid outlet 109. The fluid inlet 107 may be in fluid connection with the fluid outlet 109 and at least one of the fluidic silicon-based layers 103 *a-c*. The microfluidic device further comprises a substrate 101 onto which the stack 102 may be provided. In embodiments, the stack 102 further comprises a top layer (not shown) for sealing the microfluidic device. The top layer may be at least partially transparent and may be made from e.g. glass, Pyrex, and/or polymers.

The substrate 101 may be a silicon substrate, usually a monocrystalline silicon wafer substrate. Such wafers are known.

The fluidic silicon-based layers 103*a-c* may be made from a material comprising silicon, usually a silicon material inert to chemical etching by hydrofluoric acid (HF), such as, but not limited to, for example (polycrystalline) silicon, $Si_XN_Y$, and/or SiC. The fluidic silicon-based layers comprise a microfluidic structure adapted to transport minute volumes of fluid within the layer. In the present example, the microfluidic structure comprises fluidic channels which may contain different geometries: several other structures may be contemplated, including pillars, groves, channels and/or wells.

In the example shown in FIG. 1, the intermediate layers 105*a-b* may be made of the same material as the fluidic silicon-based layers 103*a-c*. Thus, the intermediate layers 105*a-b* also comprise a silicon-based material, such as (polycrystalline) silicon, $Si_XN_Y$, and/or SiC.

The layers have been provided by deposition or growth, such as by chemical vapor deposition or physical vapor deposition. Thus, the device 1 may be a multi-level microfluidic device which requires only one wafer substrate.

The fluidic silicon-based layers 103 may be provided with one or several fluid interconnections 111, allowing for fluid transport between individual layers. The fluid interconnections may be vertical or nearly vertical channels that enables fluid communication between individual fluid silicon-based layers.

In the embodiment shown in FIG. 1, a microfluidic device having three fluidic layers is shown. However, it would be readily understood that the number of fluidic layers could be two, or more FIG. 2 also shows a schematic illustration of a representative microfluidic device 2 according to an example of the present disclosure. In the example shown therein, the device 2 comprises three fluidic silicon-based layers 203*a-c*, and two intermediate layers 205*a-b*. The intermediate layer 205*a* separates the fluidic silicon-based layers 205*a* and *b*, and the intermediate layer 205*b* separates the fluidic silicon-based layers 203*b* and *c*. The layers 203*a-c* and 205*a-b* make up a stack 202. The device may be further provided with a fluid inlet 207 and a fluid outlet 209. The fluid inlet 207 may be in fluid connection with the fluid outlet 209 and at least one of the fluidic silicon-based layers 203*a-c*. The microfluidic device further comprises a substrate 201 onto which the stack 202 may be provided. In embodiments, the stack 202 may further comprises a top layer (not shown) for sealing the microfluidic device. In embodiments, the top layer may be at least partially transparent and may be made from e.g. glass, Pyrex, and/or polymers.

The substrate 201 may be a silicon substrate such as a monocrystalline silicon wafer substrate. Such wafers are known.

The fluidic silicon-based layers 203*a-c* may be made from a material comprising silicon, usually a silicon material inert to chemical etching by hydrofluoric acid (HF), such as, but not limited to, for example (polycrystalline) silicon, $Si_XN_Y$, and/or SiC. The fluidic silicon-based layers comprise a microfluidic structure adapted to transport minute volumes of fluid within the layer. In the present example, the microfluidic structure comprises pillars but several other structures may be contemplated, such as for example grooves, channels and/or wells.

Figure 2:
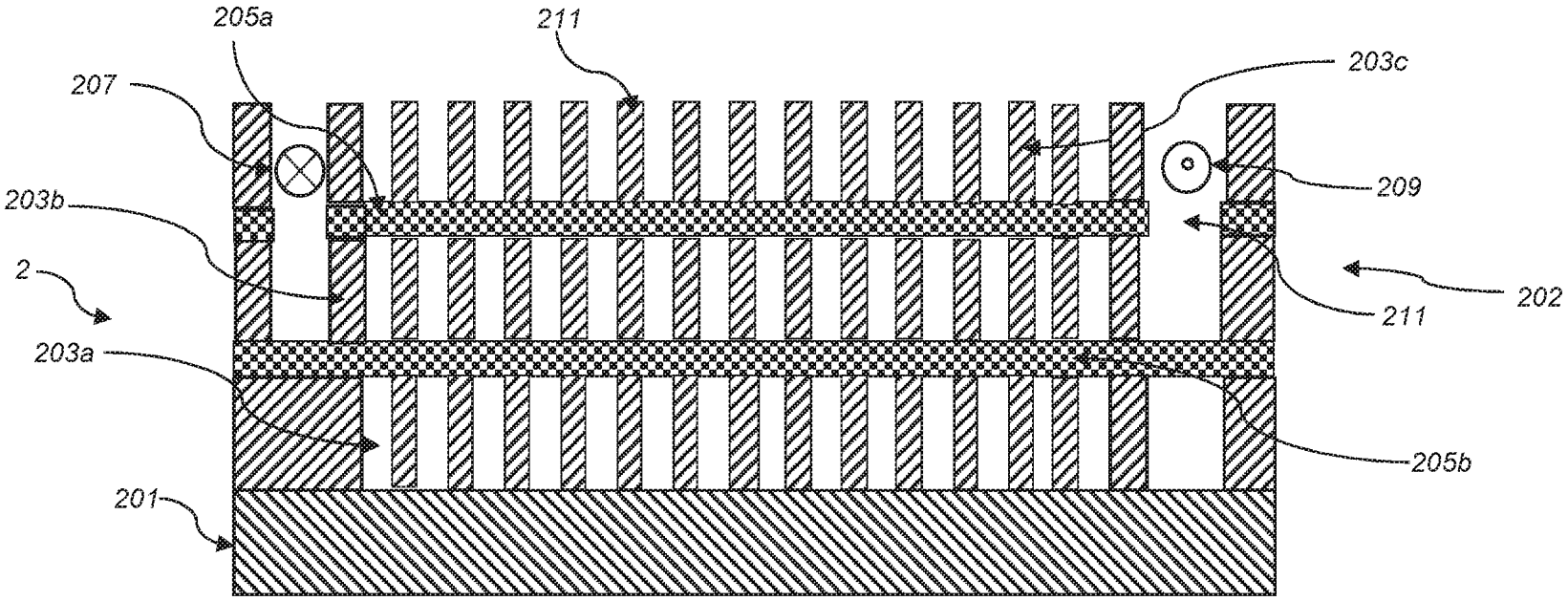
FIG. 2 is a schematic illustration in a cross-sectional view of a representative microfluidic device according to an example of the present disclosure.

In the example shown in FIG. 2, the intermediate layers 205*a-b* may be made of a different material than the fluidic silicon-based layers 203*a-b*.

The layers have been provided by deposition or growth, such as by chemical vapor deposition or physical vapor deposition. Thus, the device 2 may be a multi-level microfluidic device which requires only one wafer substrate.

The fluidic silicon-based layers 203 may be provided with one or several fluid interconnections 211, allowing for fluid transport between individual layers. The fluid interconnections may be vertical or nearly vertical channels that enables fluid communication between individual fluid silicon layers.

Figures 3A, 3B, 3C:
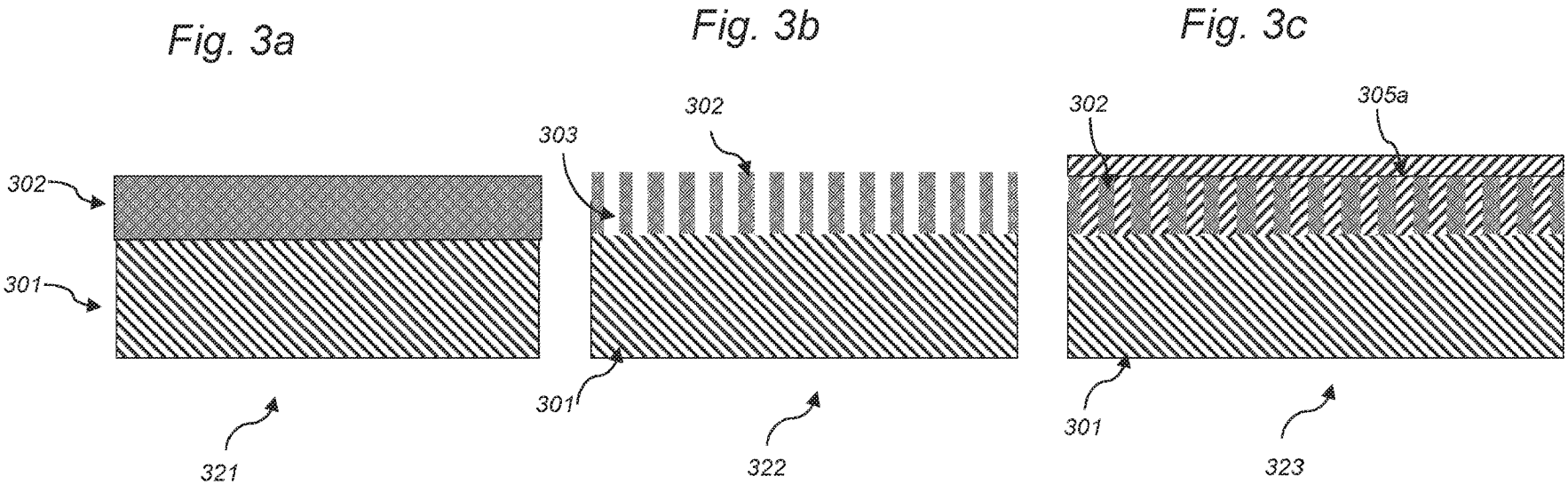
FIGS. 3*a* to 3*h* show a schematic illustration of an example method according to the second aspect.

FIGS. 3*a* to 3*h* show a schematic illustration of an example method of manufacturing a multi-level microfluidic device disclosed in the second aspect of the present disclosure. In the embodiment shown in FIGS. 3*a* to 3*h*, the layers of the first material may be sacrificial layers, usually made of $SiO_2$. FIG. 3*a* shows the first step 321 of forming a sacrificial layer 302 on a substrate 301. The substrate may be a monocrystalline silicon wafer. Herein, the term "sacrificial layer" denotes a layer that is used during the method but may be at least partially removed before the final product is achieved. The sacrificial layer may be a $SiO_2$ layer. The sacrificial layer 302 may be formed on the substrate 301 by deposition or growth, such as by chemical vapor deposition or physical vapor deposition. The sacrificial layer may be formed such that it covers the surface of the substrate.

In the embodiment shown in FIG. 2, a microfluidic device having three fluidic layers is shown. However, it would be readily understood that the number of fluidic layers could be two, or more.

FIG. 3*b* shows the second step 322 of forming a first pattern 303 in the first sacrificial layer 302. The first pattern may be formed by photolithography and dry etching, which are known techniques. The etchant should be capable of etching a pattern in the sacrificial layer, but not capable of etching the conformal layer. The first pattern 303 may have many different shapes and forms, but may in principle be used as a template for the subsequent forming of a first conformal layer shown in FIG. 3*c*.

FIG. 3*c* shows the step 323 of forming a first conformal layer 305*a* on the first sacrificial layer 302. As can be seen in FIG. 3*c*, the first conformal layer conforms to the shape of the pattern 303 in the sacrificial layer. When forming the conformal layer 305*a*, the conformal layer will conform to the shape of the pattern 303. Thus, the conformal layer fills the spaces made by the pattern. The conformal layer 305*a* may further extend above the space between the pattern 303 to form a layer on top of the patterned sacrificial layer. Herein, the conformal layer comprises silicon and may be selected from for example silicon, (poly)crystalline silicon, $Si_XN_Y$, and/or SiC. In embodiments, the conformal layer may be formed by deposition or growth. During deposition, the conformity of a layer to an underlying pattern can be tuned by selecting deposition parameters such as temperature and pressure.

The conformal layer extending above the pattern in the sacrificial layer can be removed by a step of polishing and/or etching. In some examples, the conformal layer on top of the patterned sacrificial layer may be removed completely, except for the parts of the first conformal layers that may be positioned in between the first pattern, and a further conformal layer is formed on top of the patterned sacrificial layer using deposition or growth. This may be useful in examples where a very smooth surface is desired.

Figure 3F:
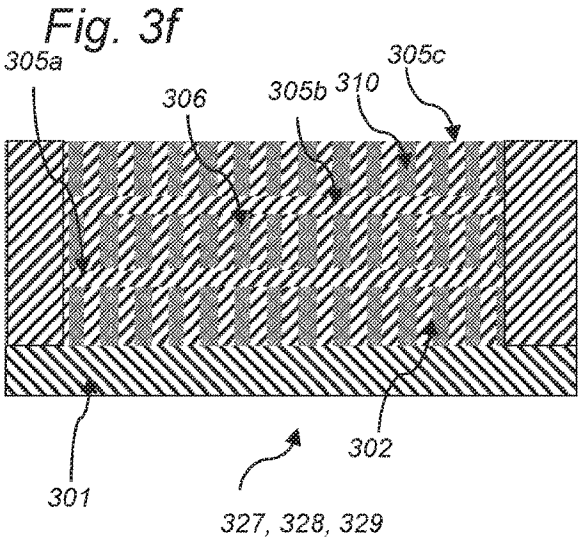
Figure 3E:
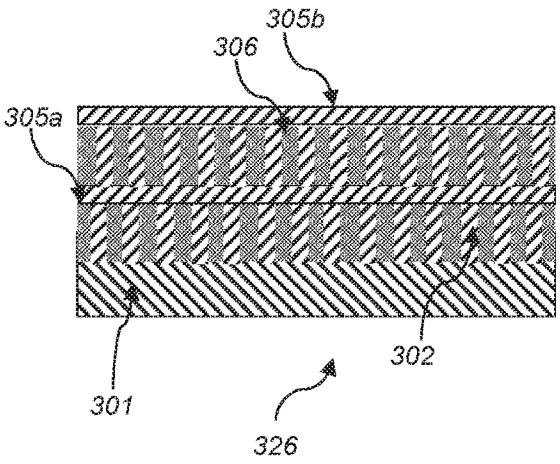
Figure 3D:
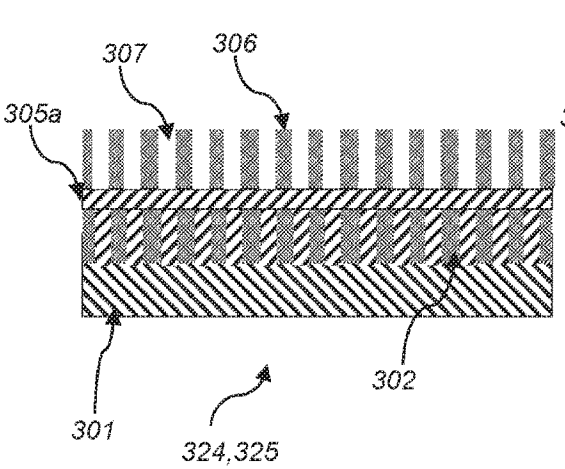

FIG. 3*d* shows the subsequent steps 324, 325 of forming a second sacrificial layer 306 on top of the first conformal layer and forming a second pattern 307 in the second sacrificial layer. The second pattern may be identical to the first pattern. The second pattern may also differ from the first pattern. In embodiments, the second pattern may be formed using photolithography and dry etching. The etchant should be capable of etching a pattern in the sacrificial layer, but not capable of etching the conformal layer.

FIG. 3*e* shows the step of forming 326 a second conformal layer 305*b* on top of the second patterned 306 sacrificial layer. After formation, the second conformal layer may extend above the pattern in the sacrificial layer. The conformal layer extending above the pattern may then be removed, and a new conformal layer may be deposited on top to achieve a desired thickness of the conformal layer.

The steps of forming a sacrificial layer, forming a pattern in the sacrificial layer and forming a conformal layer on top of the sacrificial layer may be repeated in that order to form a desired number of layers of the stack.

FIG. 3*f* shows the stack after steps of forming 327 a third sacrificial layer, forming 328 a pattern in the third sacrificial layer, and forming 329 a third conformal layer 310 such that it fills the space between the formed pattern. FIG. 3*f* shows the stack after a desired number of layers has been formed. In the example shown in FIG. 3*f*, the number of fluidic silicon layers may be three, but the present disclosure relates to any number of fluidic silicon layers equal to or above two.

Figure 3H:
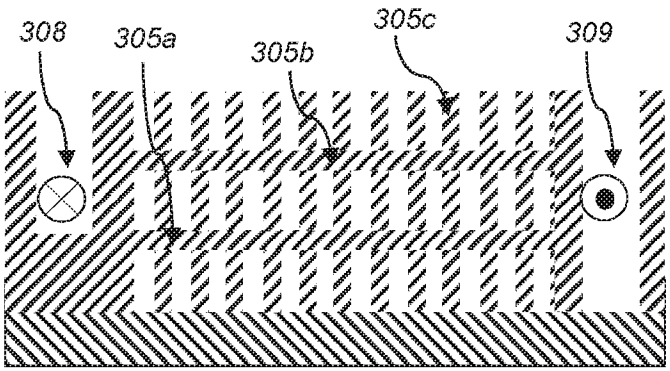
Figure 3G:
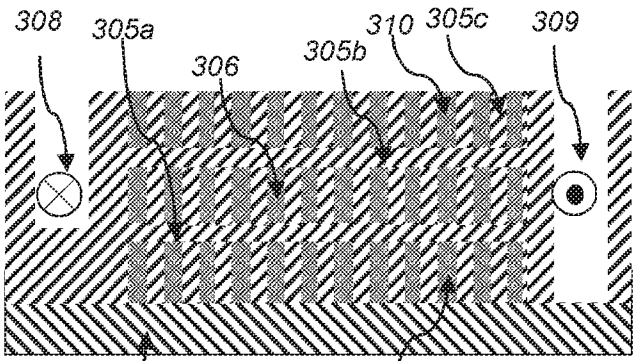

FIG. 3*g* shows the step of forming 330 a fluid inlet 308 and a fluid outlet 309. The fluid inlet 308 and the fluid outlet 309 should be in fluid communication with each other. Further optional steps include forming fluid interconnections that connects a first fluidic layer with another fluidic layer.

FIG. 3*h* shows the step 331 of removing the sacrificial layers to form a multi-level microfluidic device. After removal, the stack may be formed by the materials deposited as conformal layers 305*a-c*.

The step of removing the sacrificial layer may be typically performed by chemical etching using hydrofluoric acid. The hydrofluoric acid may be flushed into the device through the inlet. Thus, the sacrificial layer may be made of a material susceptible to chemical etching using hydrofluoric acid. Such materials include $SiO_2$.

Further optional steps include providing a final capping to the microfluidic device. In embodiments, the final capping may be transparent and may comprise for example a polymer or a glass. The step of providing a final capping may be performed before or after step 331.

When the sacrificial layers have been removed, a microfluidic device comprising a substrate and a stack comprising a plurality of fluid silicon-based layers and at least one intermediate layer, wherein the intermediate layer may be arranged between two fluidic silicon layers, may be formed. Fluidic silicon-based layers and intermediate layer(s) may be provided in an alternating fashion such that the fluidic silicon layers may be separated by an intermediate layer.

The method described in relation to the FIGS. 3*a* to 3*h* could equally well be inverted. Stated differently, in another embodiment of the second aspect the layer structure is inverted as compared to the layer structure of FIGS. 3*a* to 3*h*. Thus, the first layer 302 may also be a first silicon-based layer, the pattern 303 may be formed in the first silicon-based layer, and wherein a sacrificial conformal layer may be a first conformal layer 305*a*, the first sacrificial conformal layer conforms to the shape of the pattern 303 in the silicon-based layer and so on in an alternating fashion until the desired number of levels have been deposited. Thereafter, the sacrificial conformal layer may be removed to form a microfluidic device according to the first aspect of the present disclosure.

In the embodiment shown in FIGS. 3*a* to 3*h*, a microfluidic device having three fluidic layers may be formed. However, it would be readily understood that the number of fluidic layers could be two, or more. The method according to the second aspect may be highly scalable.

In the second aspect, one of the first material and the material of the structural layer may be a silicon-based material, such as for example (polycrystalline) silicon, SiC, or $Si_xN_y$. The other material may then be an oxide material, such as $SiO_2$, used to form the sacrificial layers.

FIGS. 4*a* to 4*h* shows a schematic illustration of an example method of manufacturing a multi-level microfluidic device disclosed in the third aspect of the present disclosure.

Figures 4A, 4B, 4C:
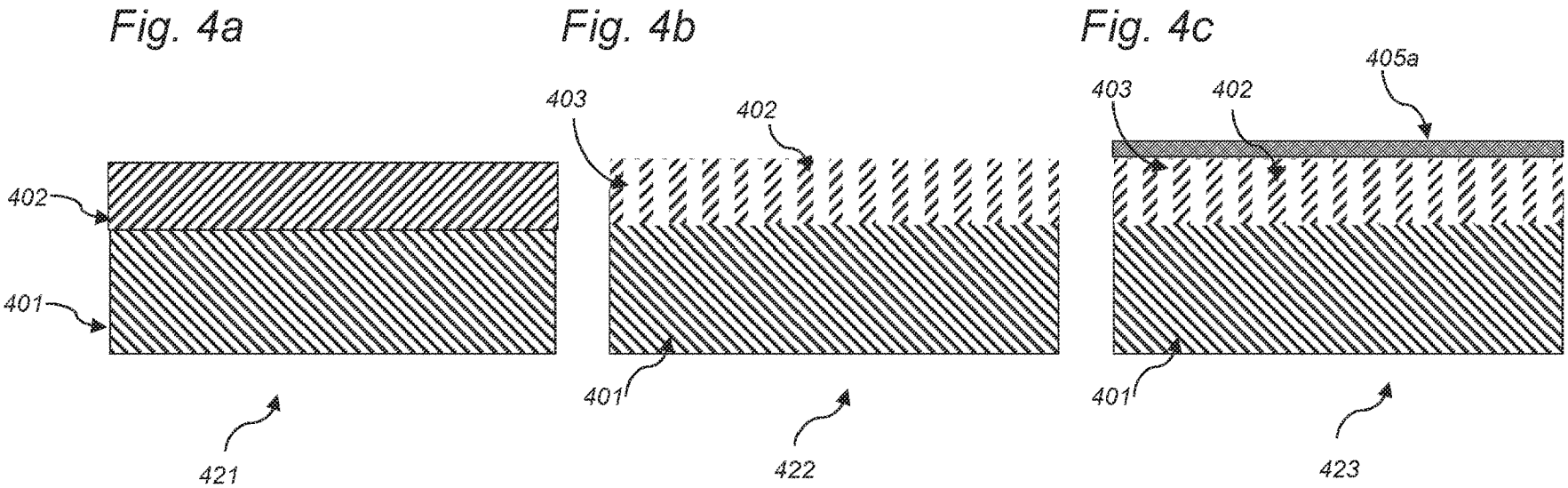
FIGS. 4*a* to 4*f* show a schematic illustration of an example method according to the third aspect.

FIG. 4*a* shows the first step 421 of providing a first silicon-based layer 402 on a substrate 401. The silicon-based layer may be formed by means of deposition or growth, such as by chemical vapor deposition or physical vapor deposition. The first silicon-based layer comprises silicon. The first silicon-based layer may be for example (polycrystalline) silicon, silicon nitride, or silicon carbide. The substrate may be a monocrystalline silicon wafer. The first silicon-based layer may be formed such that it covers the substrate material.

FIG. 4*b* shows the step 422 of forming a first pattern 403 in the first silicon-based layer 402. The pattern may be a pattern adapted to act as a microfluidic structure. The pattern may include different geometries, such as pillars, channels, grooves, wells or the like. The pattern may be formed by photolithographic masking followed by physical and/or chemical etching.

FIG. 4*c* shows the step 423 of forming a first non-conformal layer 405*a* on the first silicon-based layer. Herein, the term "non-conformal layer" denotes a layer which during deposition does not conform to the shape of the underlying layer. Herein, the non-conformal layer may be deposited (or grown) such that it does not conform to the shape of the pattern formed in the first silicon-based layer. Instead of conforming to the shape of the pattern in the first silicon-based layer, it may be provided as an intermediate layer intended for separating the first patterned silicon-based layer from a subsequent patterned silicon-based layer. The non-conformal layer may comprise a dielectric material, such as a silicon oxide. A non-conformal deposition or growth can be provided by tuning the parameters during formation.

Figure 4F:
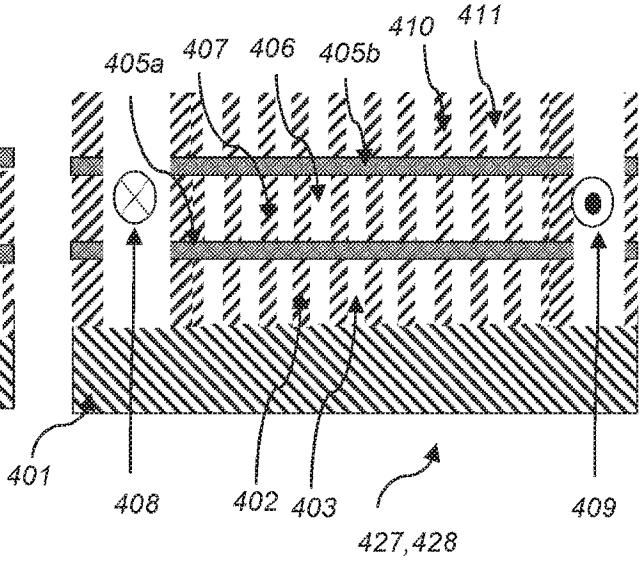
Figure 4E:
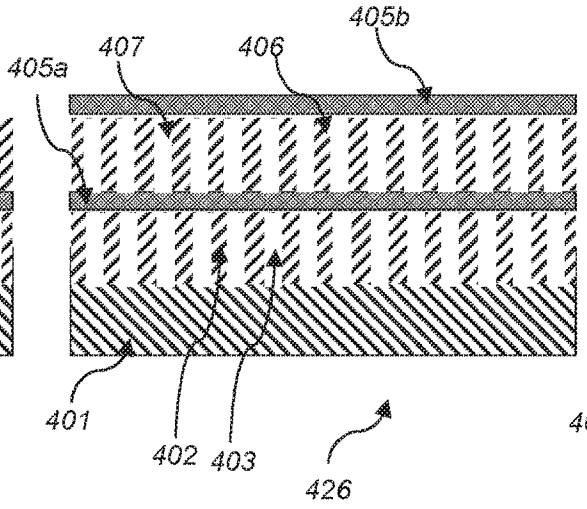
Figure 4D:
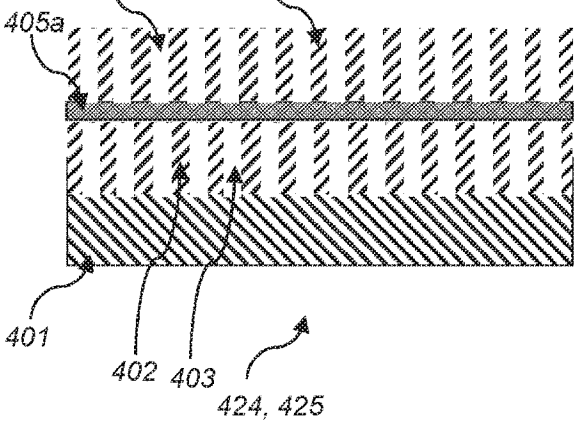

FIG. 4*d* shows the subsequent step 424 of forming a second silicon-based layer 406 on the first non-conformal layer 405*a* and the step 425 of forming a pattern 407 in the second silicon-based layer. The steps 424 and 425 may be performed in the same or a similar manner as the step 421-423, using the same types of materials. However, the second pattern may in some examples differ from the first pattern.

FIG. 4*e* shows the step 426 of forming a second non-conformal layer 405*b* on the second silicon-based layer 406. The second non-conformal layer may be formed in the same or similar manner as the first non-conformal layer. In some embodiments, the second non-conformal layer may also be a final capping that may be made of a transparent material such as a glass or a transparent polymer.

FIG. 4*f* shows the step 427 of forming a fluid inlet 408 and a fluid outlet 409 in fluid communication with each other. The fluid inlet 408 and the fluid outlet 409 may further be in fluid connection communication with at least one of the patterned silicon-based layers. FIG. 4*f* further shows the optional step 427 of forming a third silicon-based layer 410 on top of the second non-conformal layer 405*b* and the optional step of forming a third pattern 411 in the third silicon-based layer.

Further optional steps include forming a final capping on top of the third patterned silicon-based layer. It is readily understood that the method may include further steps to form further patterned silicon-based layers and non-conformal layers in an alternating manner.

In some examples, the method further comprises the step of forming a fluid interconnection between silicon-based layers. This may be performed by forming a hole in at least one non-conformal layer.

In the embodiment shown in FIGS. 4*a* to 4*f*, a microfluidic device having three fluidic layers may be formed. However, it would be readily understood that the number of layers could also be two, or higher. The method according to the second aspect is highly scalable.

The disclosure has mainly been described with reference to a limited number of examples. However, as is readily appreciated by a person skilled in the art, other examples than the ones disclosed above are equally possible within the scope of the disclosure, as defined by the appended claims.

The invention claimed is:

1. A method of manufacturing a microfluidic device, comprising the steps of:

a) forming a first layer of a first material on a substrate;

b) forming a first pattern in the first layer;

c) forming a first conformal layer on the first layer, wherein the first conformal layer conforms to the first pattern in the first layer;

d) forming a second layer of the first material on the first conformal layer;

e) forming a second pattern in the second layer;

f) forming a second conformal layer on the second layer, wherein the second conformal layer conforms to the second pattern in the second layer; and g) removing the first and second layers of the first material with chemical etching, wherein the first and second layers of the first material are sacrificial layers and wherein the first and second conformal layers are inert to the chemical etching.

2. The method according to claim 1, wherein the steps a), c), d), and f) are performed by deposition or growth.

3. The method according to claim 2, wherein the deposition is chemical vapor deposition or physical vapor deposition.

4. The method according to claim 2, wherein the growth is selected from epitaxial, layer-by-layer, joint islands, layer-plus-island, and isolated islands growth modes.

5. The method according to claim 1, wherein the first conformal layer comprises a material that is inert to hydrofluoric acid etching.

6. The method according to claim 1, wherein the second conformal layer comprises a material that is inert to hydrofluoric acid etching.

7. The method according to claim 1, wherein the first conformal layer and/or second conformal layer comprises a silicon layer.

8. The method according to claim 1, wherein the first sacrificial layer and the second sacrificial layer are dielectric layers.

9. The method according to claim 1, wherein the first and second conformal layers are made of (polycrystalline) silicon, silicon carbide, or silicon nitride.

10. The method according to claim 1, wherein step (g) is performed by hydrofluoric acid etching.

* * * * *